US005764535A

United States Patent [19]

Okazaki et al.

[11] Patent Number: 5,764,535

[45] Date of Patent: Jun. 9, 1998

[54] FURNACE INSIDE STATE ESTIMATION CONTROL APPARATUS OF PULVERIZED COAL COMBUSTION FURNACE

[75] Inventors: Hirofumi Okazaki; Hironobu Kobayashi, both of Hitachi; Masayuki Taniguchi, Hitachinaka; Ken Amano, Hitachiota; Toshiyuki Tanaka; Hisayuki Orita, both of Hitachi; Kenji Kiyama, Kure, all of Japan

[73] Assignees: Hitachi, Ltd.; Babcock-Hitachi Kabushiki Kaishi, both of Tokyo, Japan

[21] Appl. No.: 743,811

[22] Filed: Nov. 6, 1996

[30] Foreign Application Priority Data

Nov. 7, 1995 [JP] Japan ..... 7-288283

[51] Int. Cl.[6] ..... F23N 5/00

[52] U.S. Cl. ..... 364/503; 364/500; 364/578

[58] Field of Search ..... 364/503, 500, 364/557, 578, 550, 130, 149; 236/15 E, 15 R, 15 BR; 75/492, 375; 126/116 A; 431/2, 8

[56] References Cited

U.S. PATENT DOCUMENTS 4,622,922 11/1986 Miyagaki et al. ..... 122/449
4,976,780 12/1990 Amano et al. ..... 364/500 X
5,623,425 4/1997 Yoda ..... 364/149 X

FOREIGN PATENT DOCUMENTS 507060 2/1992 European Pat. Off. .
5-264005 1/1994 Japan .

OTHER PUBLICATIONS

Sidlauska et al., "Mathematical Modeling of the Thermal Process in Industrial Combustion Chambers" Heat Transfer–Soviet Research v.23 n.7 pp. 897–914, 1991.

Boyd et al., "Three dimensional Furnace Computer Modeling" Proceedings of the 21st Symposium on Combustion, pp. 265–274, 1986.

*Primary Examiner*—James P. Trammell
*Assistant Examiner*—M. Kemper
*Attorney, Agent, or Firm*—Fay, Sharpe, Beall, Fagan, Minnich & McKee

[57] ABSTRACT

When at least one of a distribution of gas composition and distribution of temperature inside a furnace is estimated by dividing the region inside the furnace into two-dimensional or three-dimensional cells, and calculating a gas flow rate, a gas reaction amount, a coal combustion rate, a radiant heat transfer rate in each of the cells, based on design data including furnace dimentions and operational data including a coal supply rate and an air supply rate, an air ratio of gas phase—gas composion table is referred to, thereby to simplify the gas reaction amount calculation and reduce drastically time required for the calculation.

11 Claims, 12 Drawing Sheets

FURNACE INSIDE STATE ESTIMATION CONTROL APPARATUS OF PULVERIZED COAL COMBUSTION FURNACE

BACKGROUND OF THE INVENTION

1. Field of Industrial Application

The present invention relates to a furnace inside state estimation control apparatus of a pulverized coal combustion furnace which estimates a furnace inside state of a combustion furnace provided with burners for burning pulverized coal pneumatically conveyed and controls a supply rate of the pulverized coal, a supply rate of air, etc. and, particularly to a calculation program for obtaining, by calculation, a gas composition distribution and a temperature distribution inside the combustion furnace.

2. Description of Prior Arts

Burning of coal exhausts an environmental pollution substance of nitrogen oxide ($NO_x$). There have been proposed various kinds of burning method to reduce an amount of exhausted $NO_x$. However, in order to reduce an amount of exhausted $NO_x$, it is necessary to understand a state inside the furnace. In a pulverized coal burning boiler, a plurality of burners are provided on the wall of a furnace, and an after-air inlet port is provided in the upper portion of the burner stage. Number of burners used are changed or a rate of air supplied to the after-air inlet ports is adjusted depending on the load, but by doing so non-uniformity occurs in the distribution of temperature or the distribution of gas compositions in the furnace. Further, there is difference in flame states of the burners due to difference in pressure loss of piping systems for supplying the pulverized coal and air. Therefore, it is necessary to perform proper control by observing the inside of the furnace to know from which portion $NO_x$, carbon monoxide and unburned coal are exhausted.

If various kinds of meters can be directly inserted inside the furnace, it is easy to obtain the distribution of gas compositions and the distribution of temperature inside the furnace. However, since the inside of the furnace is in a high temperature state, it is practically impossible. Therefore, it is necessary to obtain the distribution of temperature and the distribution of gas composition through calculation.

A method is disclosed in Japanese Patent Application Laid-Open No.5-264005 where temperature inside a furnace and steam temperature at the exit of a primary heater are estimated by dividing the inside of the furnace into a plurality of sections by vertical plane and calculating temperature at the exit of the furnace and an amount of heat absorption of the water wall, using a physical model.

In the conventional technology described above, a distribution of gas components inside a furnace is not obtained. Further, heat generating portions inside the furnace and the heat generating rate are empirically determined and incorporated into a physical model. Therefore, when arrangement of pulverized coal burners or load is largely changed, it is required to calculate again by changing the physical model. Furthermore, when a distribution of gas compositions in a furnace is known, it is easy to control burning since it can be known in which zone $NO_x$ and carbon monoxide are generated much.

SUMMARY OF THE INVENTION

An object of the present invention is to provide a furnace inside state estimation control apparatus of pulverized coal combustion furnace provided with means capable of estimating both the distribution of gas composition and the distribution of temperature inside the combustion furnace by calculation.

Another object of the present invention is to provide a concrete control means for controlling operating conditions, based on the calculated result of the distribution of gas composition and/or the distribution of temperature.

The present invention is, in a furnace inside state estimation control apparatus of a pulverized coal combustion furnace, comprising a calculation program for obtaining, by calculation, at least one of a distribution of temperature and a distribution of gas compositions inside the pulverized coal combustion furnace, a display for displaying at least one of the distribution of temperature and the distribution of gas composition, obtained by the calculation program, and a control means for controlling operation conditions on the basis of at least one of the distribution of temperature and the distribution of gas composition, characterized in that the furnace inside state estimation control apparatus comprises a table of air ratio of gas phase-gas composition in which the gas composition produced by combustion of coal under the condition of furnace inside temperature from 1000K to 2500K and the condition of gas composition of a air ratio of gas phase from 0.6 to 4.0 are obtained from gas reaction calculation or from sampling results of the reaction furnace and arranged in a relation with the air ratio of gas phase, and the calculation program includes all the following first to fourth steps and at least one of the following fifth and sixth steps:

(1) the first step of dividing the inside of the furnace into a plurality of two-dimensional or three-dimensional cells, executing gas flow rate calculation for each of the cells from data specific to the furnace design including the furnace dimensions and operational data including a coal feeding rate and air supply rate to obtain enthalpy entered each cell, enthalpy come out of each cell, components and amount of gas and an amount of coal, each entering each cell;

(2) the second step of calculating air ratio of gas phase and specific heat of gas phase of each cell from the components and an amount of gas entering each cell, obtained in the first step and an initial temperature of each cell, searching the table of air ratio of gas phase-gas composition by indexes of the obtained air ratio of gas phase to obtain the composition and amount of gas corresponding to the air ratio of gas phase;

(3) the third step of obtaining an amount of heat generation by combustion of coal and components and amount of gas converted from the coal for each cell on the basis of the components and amount of the gas, obtained in the second step, an amount of coal in each cell, obtained from the amount of coal entered each cell and the amount of coal come out of each cell, and the initial temperature of each cell used for calculation in the second step;

(4) the fourth step of obtaining a radiant heat transfer amount of each cell from the initial temperature of each cell, used for calculation in the second step;

(5) the fifth step of calculating enthalpy in each cell from the enthalpy entered each cell and enthalpy come out of each cell, obtained in the first step, the heat generation amount of coal in each cell, obtained in the third step and the radiant heat transfer amount of each cell, obtained in the fourth step, and calculating temperature of each cell from the enthalpy and the specific heat of each cell, obtained in the second step to obtain a temperature distribution inside the furnace; and (6) the sixth step of calculating components and amount of gas in each cell from the components and amount of gas entered each cell, obtained in the first step, the components and amount of gas of each cell, obtained in the second step, the components and amount of gas converted from coal, obtained in the third step to obtain a gas composition distribution inside the furnace.

The calculation program used in the present invention can include the step of comparing a temperature of at least one cell among respective temperatures of the cells obtained in the fifth step with the previous calculated temperature of the at least one cell, repeating the calculation of the second step to the fifth step, using the current calculated temperature when the difference exceeds a preset allowable temperature difference, and repeatedly executing the calculation using new calculated temperature until the difference between the above-mentioned previous calculated temperature and new calculated temperature converges within the allowable temperature difference.

In this case, the cell of which the previous calculated value is compared with the allowable temperature difference is desirable to be a cell at an outlet of the furnace.

In the present invention, it is desirable to provide a plurality of tables of air ratio of gas phase-gas composition according to a ratio between hydrogen and carbon in pulverized coal, or a ratio between carbon, hydrogen and oxygen. And, it is desirable to provide an analyzer which obtains an element ratio between carbon, hydrogen and oxygen in pulverized coal and an amount of heat generation of the pulverized coal, and use the table of air ratio of gas phase-gas composition, accorded with the analysis result of the pulverized coal when a furnace inside state of the combustion furnace is estimated.

In a case where the combustion furnace is provided with a plurality of burners for jetting pulverized coal and carrier gas of the coal and an after-air supply port at a furnace wall thereof, as an example of the above-mentioned control means, it is desirable to provide such a control unit as to control air supply rates for the plurality of burners and the after air supply port so that an air ratio in a lower region than the after air supply port does not exceed 0.85.

Further, as another example of the control means, it is desirable to provide such a control unit as to compare a coal combustion rate at the furnace outlet, estimated from the distribution of furnace inside temperature obtained by the calculation program with a preset coal combustion rate at the furnace outlet, and control an air supply rate for the plurality of burners and the after air supply port so that the estimated coal combustion rate is higher than the preset value.

Additionally to the above-mentioned, as the control means, it is possible to provide (i) a control unit which compares a gas composition at the furnace outlet, estimated from the distribution of furnace inside gas composition obtained by the calculation program with a preset gas composition at the furnace outlet, and controls air supply rates for the plurality of burners and the after air supply port and a coal supply rate for the plurality of burners so that the estimated gas composition is within the preset value, (ii) a control unit which obtains thermal energy absorbed in the furnace wall and the heat exchanger from the distribution of furnace inside temperature obtained by the calculation program, calculates a temperature and amount of steam generated in the heat exchanger and controls at least one of an air supply rate for the plurality of burners and the after air supply port, a coal supply rate for the plurality of burners and a water supply rate for the heat exchanger so that the calculated temperature and amount of steam are within the preset values, and (iii) a control unit which obtains thermal energy absorbed in the furnace wall and the heat exchanger from the distribution of furnace inside temperature obtained by the calculation program, calculates a temperature and pressure of steam generated in the heat exchanger, estimates the thickness of combustion ash adhered to the heat exchanger on the basis of change with time of deviation between the calculated value and the temperature and pressure of steam really generated in the heat exchanger, and instructs an ash adhesion operation to the heat exchanger when the estimated value exceeds a preset value.

It is further desirable to provide a temperature measuring means for measuring temperature from the brilliance of flames in the combustion furnace and a temperature correcting means for correcting the temperature distribution obtained in the fifth step on the basis of a measured temperature value.

According to the present invention, when gas flow rate calculation, gas reaction amount calculation, coal combustion amount calculation and radiant heat transfer calculation, for each cell are executed on the basis of data (unchangeable information) inherent to the furnace design such as the furnace dimensions and operational information such as a coal supply rate, an air supply rate, etc., the gas reaction amount calculation for which longest time is required is simplified by referring to the table of air ratio of gas phase-gas composition, so that the time required for calculation can be drastically reduced.

Further, it is possible to achieve burning with less emission of nitrogen oxides by controlling operational conditions of the furnace on the basis of the furnace inside temperature distribution and the furnace inside gas composition distribution, obtained according to the present invention.

DESCRIPTION OF EMBODIMENTS

Embodiments of the present invention will be described in detail below, referring to the accompanying drawings.

Figure 1:
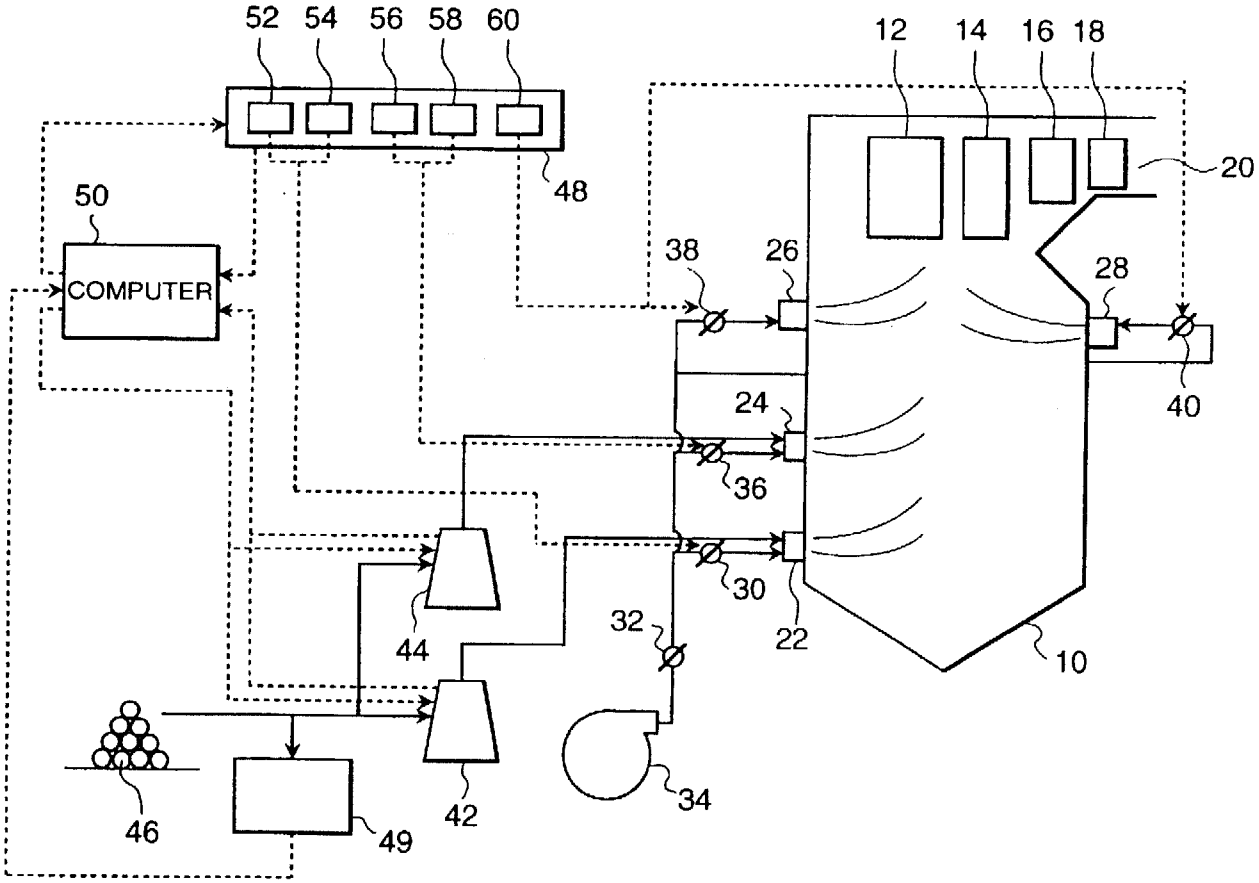
FIG. 1 is a view showing the overall construction of a first embodiment of a pulverized coal burning boiler in accordance with the present invention.

FIG. 1 is a view showing the overall construction of a first embodiment of a pulverized coal burning boiler in accordance with the present invention. Referring to FIG. 1, a pulverized coal burning boiler has a furnace 10 as a main body of the boiler, and inside the furnace 10 heat transfer pipes (not shown) are arranged along walls of the furnace and a plurality of evaporators (super-heaters) 12, 14, 16, 18 are arranged in the exit side 20 of the furnace. Water or steam is supplied to these heat exchangers (which each are the generic name including the heat transfer pipes and the evaporators) through a feed water pipe (not shown), and each of the heat exchangers generates steam by burning in the furnace 10 and the steam is supplied to a steam turbine (not shown). Further, a lower stage burner 22, an upper stage burner 24 and after-air injecting ports 26, 28 are arranged in a furnace wall of the furnace 10. The lower stage burner 22 and the upper stage burner 24 are arranged in a blowing box (not shown) for temporarily storing air, arranged in the furnace wall, and air is supplied to the lower stage burner 22 from a blower (plunger blower) 34 through air flow rate regulators 30, 32 and air is supplied to the upper stage burner 24 from the blower 34 through air flow rate regulators 36, 32. Further, air is also supplied to the after-air injecting ports 26, 28 through air flow rate regulators 38, 40. Furthermore, pulverized coal pulverized by a coal mill 42 is transmitted to the lower stage burner 22 as fuel, and pulverized coal pulverized by a coal mill 44 is transmitted to the upper stage burner 24 as fuel. Fuel coal is transmitted from a coal stock yard 46 to each of the coal mills 42, 44. The air and the pulverized coal supplied to the lower stage burner 22 are mixed and burned inside the furnace 10 to form flame inside the furnace 10. The air and the pulverized coal supplied to the upper stage burner 24 are mixed and burned inside the furnace 10 to form flame inside the furnace 10. As the flame is formed inside the furnace 10, the thermal energy is transmitted to the heat transfer pipes and the evaporators 12, 14, 16, 18 to generate steam in the heat transfer pipes and the evaporator. Then, the produced substances by burning of the air and the coal are exhausted from the exit 20.

In the present embodiment, a controller 48 and a computer 50 are provided in order to control the air flow rates to the lower stage burner 22, the upper stage burner 24 and the after-air injecting ports 26, 28 and the pulverized coal flow rates to the lower stage burner 22 and the upper stage burner 24 and in order to estimate the burning state inside the furnace 10. The controller 48 has a lower stage burner air flow rate controller 52, a lower stage burner pulverized coal flow rate controller 54, an upper stage burner air flow rate controller 56, an upper stage burner pulverized coal flow rate controller 58 and an after-air injecting port air flow rate controller 60.

The lower stage burner air flow rate controller 52 and the lower stage burner pulverized coal flow rate controller 54 execute control calculations according to a command from the computer 50, and the calculated result is input to the computer 50. The computer 50 stores information on transferring rates of pulverized coal from the coal mills 42, 44, pulverizing rates of pulverized coal of the coal mills 42, 44 and so on, and information from a coal analyzer 49, and the computer 50 outputs, to the coal mills 42, 44, commands such as commands for the transferring rates of pulverized coal, the pulverizing rates of pulverized coal and so on based on the information from the coal mills 42, 44 and the calculation result in each of the controllers 52, 54. The upper stage burner air flow rate controller 56, the upper stage burner pulverized coal flow rate controller 58 and the after-air injecting port air flow rate controller 60 execute control calculations according to a command from the computer 50, and output control signals according to the calculated results to the air flow rate regulators 30, 32, 36, 38, 40.

Further, the computer 50 stores an estimating program for calculating an estimation of a burning state inside the furnace 10 in addition to programs for executing various kinds of control calculation, and various kinds of input data are input to the computer 50. The input data is data inherent to furnace design such as dimensions of the furnace, number of the burners, type of burning (opposed or one-side), positions of the burners, spacing of the burners, position of the after-air injecting ports, spacing of the after-air injecting portions adjacent to each other and the like, and operating data such as characteristics of coal, for example, industrial analysis values of the coal, element analysis values of the coal, density of the coal, distribution of grain size (distribution of grain size of the pulverized coal) and so on, supplying rate of coal, air fuel ratio for the burner, supplying rate of after-air, water supplying rate to the heat pipes and the evaporators, temperature of the heat pipes and the evaporators and so on.

Figure 2:
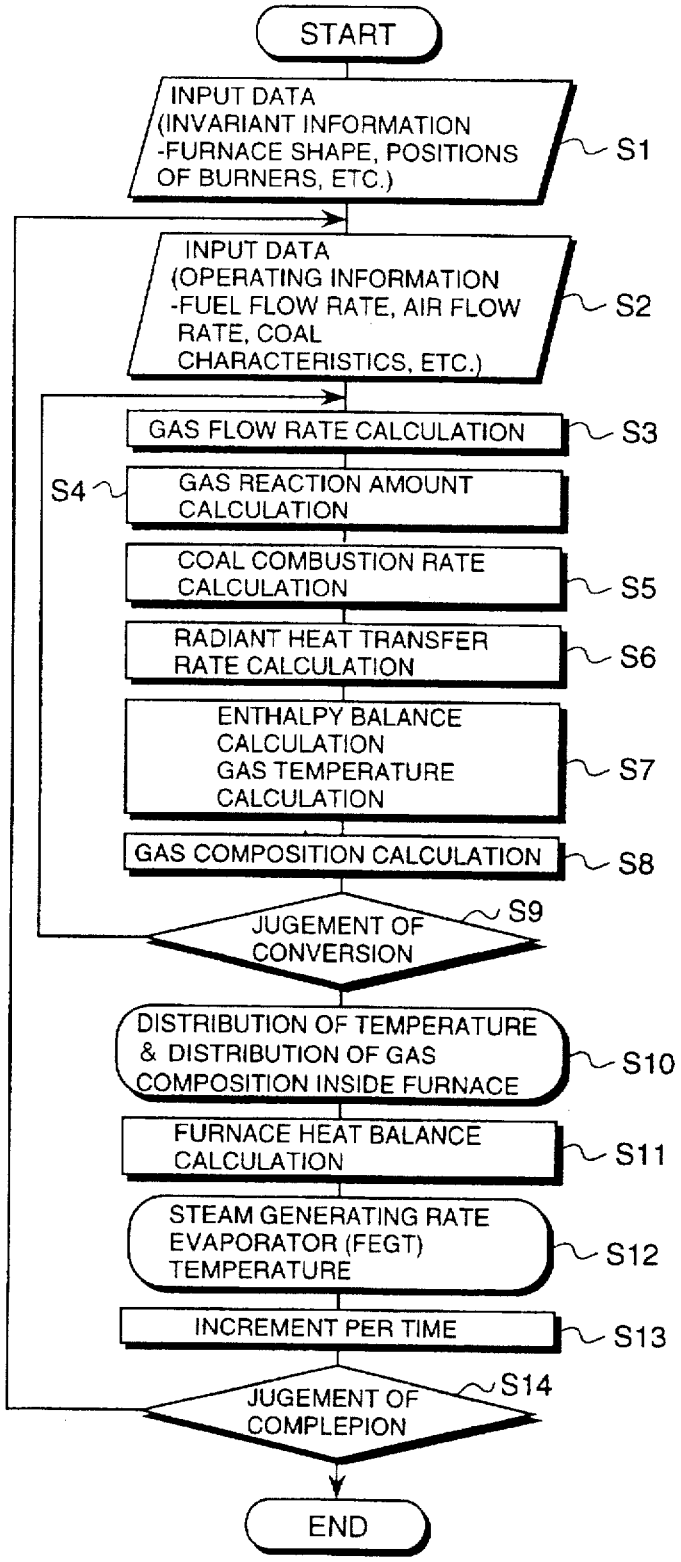
FIG. 2 is a flow chart showing the steps of estimating a state inside a furnace through calculation.

When a burning state inside the furnace 10 is estimated by calculation based on the input data using the computer 50, processing as shown in FIG. 2 is executed.

Firstly, the data inherent to the furnace design such as the shape of the furnace 10, positions of the burners and the like is input to the computer 50 as input data (S1). Further, operating information such as fuel supplying rates (supplying rate of pulverized coal supplied to each of the burners 22, 24), air supplying rates (air supplying rate to each of the burners and the after-air injecting ports 26, 28=actual air flow rate), characteristics of coal and so on is input to the computer as input data (S2).

Figure 3:
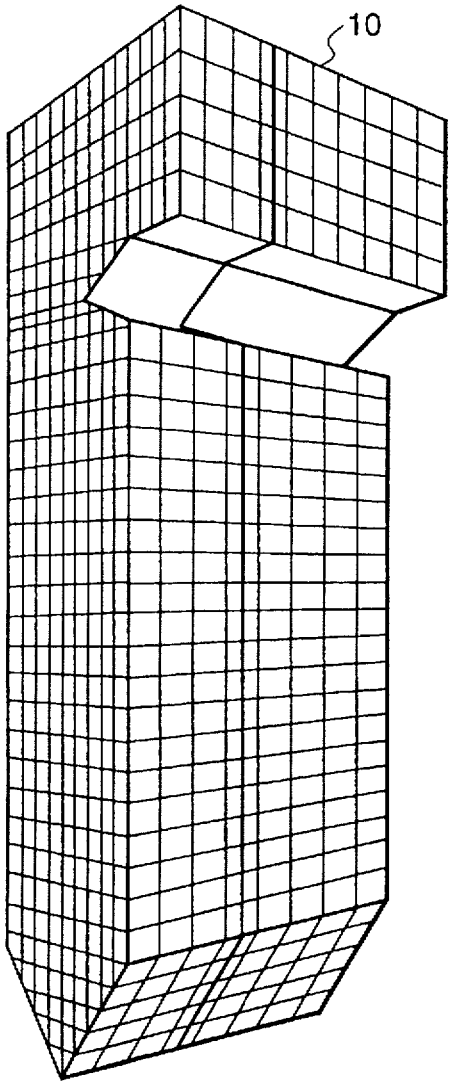
FIG. 3 is a view showing the construction inside a furnace 10 when the inside region of the furnace is divided into two-dimensional cells or three-dimensional cells.

As the input data is input to the computer 50, the computer 50 repeats execution of the processing from Step S3 to Step S7 based on the stored estimating program and the like and calculates to estimate a distribution of temperature inside the furnace 10 and a distribution of gas composition inside the furnace 10 based on each of the processed results. When the estimating calculation is performed, the inside of the furnace 10 is divided into a plurality of cells (cells set for the purpose of calculation) of two-dimension (height×depth) or three-dimension (height×depth×width). Then, for each of the cells, gas flow rate calculation (S3) for calculating gas flow velocity (rate) in each of the cells, gas reaction amount calculation (S4), coal-gas reaction (coal combustion rate) calculation (S5), radiant heat transfer rate calculation (S6), enthalpy balance calculation and gas temperature calculation (S7), gas composition calculation (S8) and judgement of conversion (S9) are executed in taking effects between the cells into consideration. FIG. 3 shows an example of dividing the inside of the furnace 10 into a plurality of cells.

In the calculations Steps S3 to S8, reaction between $O_2$ and gas such as CO and so on is calculated in the gas reaction amount calculation (S4), and reaction between carbon (C) in solid state and the other molecules such as $O_2$, $CO_2$, $H_2O$, that is, reaction amount between solid and gases is calculated in the coal-gas reaction calculation (S5).

In the gas flow rate calculation (S3), differential equations shown by the following equations (1) and (2) are calculated for each of the cells through finite differential method. The equation (1) of the both equations (1),(2) expresses conservation of mass for the gas components, and the term Sin in the equation (1) indicates the mass of gas compositions changed from pulverized coal by burning. The characters u and v indicate velocities of the gas in the lateral direction and in the perpendicular direction in each of the cells, respectively. As boundary condition of the velocity, the velocity which is 0 (zero) on wall surface, and calculated from an air injecting rate in the input data for a cell facing the burner nozzle and from the area of the burner nozzle obtained from an coordinate X, Y of each cell, is given. Further, the equation (2) expresses a transportation equation, and the term Sreact indicates a heat generating rate produced by burning. The value is obtained from the gas reaction amount calculation (S4) and the coal-gas reaction calculation (S5). The term Srad indicates an amount of received heat by radiant heat transfer, and the amount of received heat is obtained from the radiant heat transfer rate calculation (S6).

$$\frac{\partial \rho}{\partial t} + \frac{\partial}{\partial x}(\rho u) + \frac{\partial}{\partial y}(\rho v) = \mathrm{Sin} \tag{1}$$

wherein x, y: coordinate u, v: velocity

ρ: density.

Other than the simultaneous equation concerning the transportation equation, there is a simultaneous equation concerning a coal amount. The simultaneous equation concerning a coal amount can be expressed by replacing enthalpy in the equation (2) by a coal amount, that is, an equation (3). In the same manner as the calculation of enthalpy balance, a flow rate of coal flowing into each cell and a flow rate of coal flowing out of each cell are calculated in the gas flow rate calculation (S3). In this time, as the boundary condition of coal amount, a coal injection amount per unit time and unit area in the cell facing the burner nozzle is calculated on the basis of the coal injection amount and the burner nozzle area in the stored data and given.

$$\frac{\partial H}{\partial t} + \frac{\partial}{\partial x}\left(uH - \alpha\frac{\partial H}{\partial x}\right) + \frac{\partial}{\partial y}\left(vH - \alpha\frac{\partial H}{\partial y}\right) = \mathrm{Sreact} + \mathrm{Srad} \tag{2}$$

$$\frac{\partial C}{\partial t} + \frac{\partial}{\partial x}\left(uC - \beta\frac{\partial C}{\partial x}\right) + \frac{\partial}{\partial y}\left(vC - \beta\frac{\partial C}{\partial y}\right) = -\mathrm{Sin} \tag{3}$$

wherein

α: temperature diffusion coefficient

H : enthalpy

β: particle diffusion coefficient

C: particle concentration

The gas reaction amount calculation (S4) uses a chemical equilibrium calculation method described in, for example, "Mechanical Engineering Hand book, Fundamental art, A6 Thermal Engineering", p7 to p74 (published by The Japan Society of Mechanical Engineers). In addition to the chemical equilibrium calculation method, the gas reaction calculation may use a method dealing with a reaction velocity constant of Arrhenius type equation shown by the following equation (4) as described in "Mechanical Engineering Hand book, Fundamental Part, A6 Thermal Engineering". However, the method has a disadvantage for practical use in that the calculation is very complex and takes a long time since coal burning produces many kinds of intermediate products during burning reaction process and there are chain reactions of the intermediate products. On the other hand, the method of using the chemical equilibrium calculation is not required to take the reaction of the intermediate products and can execute calculation immediately since the chemical equilibrium calculation method calculates the reaction by assuming that the reaction reaches the final state (chemical equilibrium state) and does not change further.

There are two reaction types of coal burning, that is, gas reaction and coal-gas reaction. It has been found that the gas reaction can be arranged using an air ratio of gas phase and chemical equilibrium calculation can be applied. That is, it has been clarified that in the gas reaction an equilibrium state is satisfied and the chemical equilibrium calculation can be applied.

The term "an air ratio of gas phase" means a ratio of an amount of actually injected air to an amount of air required for completely burning burnable components released in the form of gas from pulverized coal (Stoichiometric Ration of gas=SRg(−)).

Coal-gas reaction is a reaction between solid and gas, and the reaction velocity is extremely slow compared to gas reaction. Therefore, in the coal-gas reaction calculation (S5), the reaction velocity constant can be given by the equation of Arrhenius type shown by Equation (4). The reaction velocity (rate) of coal can be calculated from a reaction velocity constant, a partial pressure of the gases involving the reaction and a surface area of coal grains as shown by the following equation (5). An amount of heat Sreact generated by burning of coal can be calculated from the following equation (6) using a reaction velocity.

$$kf = A\,exp\{-E/RT\} \tag{4}$$

wherein kf: reaction velocity constant

E: activation energy of reaction

R: general gas constant

T: temperature

A: frequency factor $$\frac{dWci}{dt} = ki \cdot Pi \cdot \mathrm{Sext} \tag{5}$$

wherein ki: reaction velocity constant of each reaction dwci/dt: reaction velocity of coal Pi: partial pressure of gas involving each reaction (i=$O_2$, $H_2O$, $CO_2$)

Sext: surface area of coal grains

Examples of the reaction i are as follows;

$$\mathrm{Coal}\ (C) + 1/2\ O \rightarrow CO$$
$$\mathrm{Coal}\ (C) + H_2O \rightarrow CO + H_2$$
$$\mathrm{Coal}\ (C) + CO_2 \rightarrow 2\ CO$$

$$\mathrm{Sreact} = \frac{dWci}{dt} \times \Delta H\mathrm{react} \tag{6}$$

wherein ΔHreact: amount of heat generated by reaction of coal.

The radiant heat transfer rate calculation (S6) can employ a method in which an amount of heat Srad received by radiation heat transfer can be calculated from transmission equation for thermal radiation described in "Mechanical Engineering Hand book, Fundamental Part, A6 Thermal Engineering", p104 to p107.

Figure 6A:
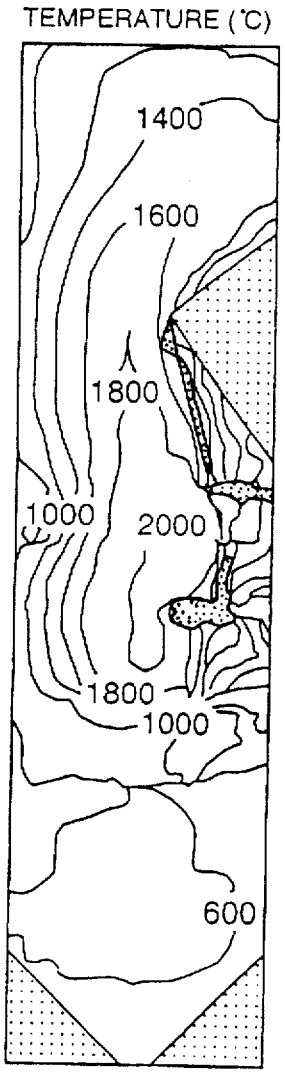
FIG. 6 is charts showing an estimated result of distribution of temperature and distribution of gas compositions obtained through estimating calculation according to an estimating program.
Figure 6B:
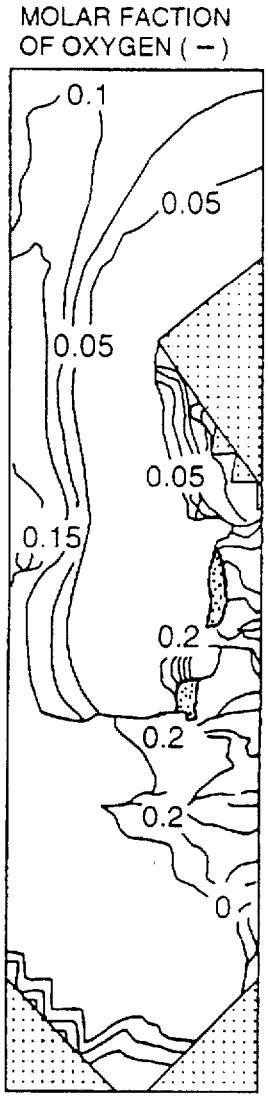

In the gas flow rate calculation (S3), the gas reaction amount calculation (S4), the coal combustion rate calculation (S5) and the radiant heat transfer rate calculation (S6), the individual calculated results affect each other of gas temperature and gas composition and amount, and gas flow rate. Accordingly, it is necessary to successively repeat the respective calculations until each of the calculated results converges. Therefore, at least one among temperatures of the respective cells obtained by the gas temperature calculation (S7) is compared with the temperature of the same cell obtained by the previous calculation. When the difference exceeds a preset allowable temperature difference, the above-mentioned calculation from (S3) to (S8) are repeatedly executed using the currently obtained temperature, and the calculations are repeated using newly obtained temperature until difference to the above-mentioned previous calculated value converges within the allowable temperature difference. Although the cell in which the converging condition is judged can be at any position inside the combustion furnace, it is desirable for conversion judgement in the calculation of the entire combustion furnace to use a cell at the outlet of the combustion furnace. Further, as the calculated results for the conversion judgment, gas composition and amount, gas flow rate can be used. When it is judged that each of the respective calculated results converges (S9), a distribution of gas compositions and a distribution of temperature inside the furnace are calculated from the respective calculated results (S10). The calculated results are transmitted from the computer 50 to a display and/or a printer (not shown), and the distribution of gas compositions and the distribution of temperature inside the furnace, for example, those shown in FIG. 6(*a*) and (*b*) are displayed on a screen of the display.

Since the distribution of gas compositions and the distribution of temperature inside the furnace are known as described above, it can be understood in which portion inside the furnace imperfect burning occurs. Therefore, by adjusting a flow rate of pulverized coal and/or a flow rate of air supplied to a burner and/or an after-air injecting port near the portion, it is possible to perform burning with small $NO_x$ exhaust and small unburned substance.

Figure 4:
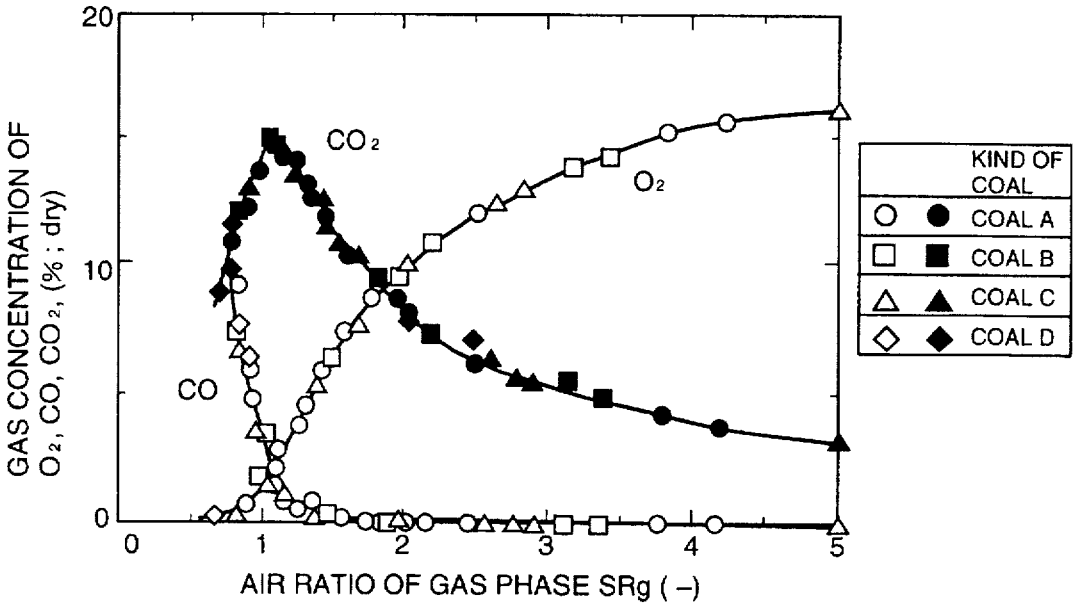
FIG. 4 is a characteristic graph showing the relationship between air ratio of gas phase and gas concentration.
Figure 5:
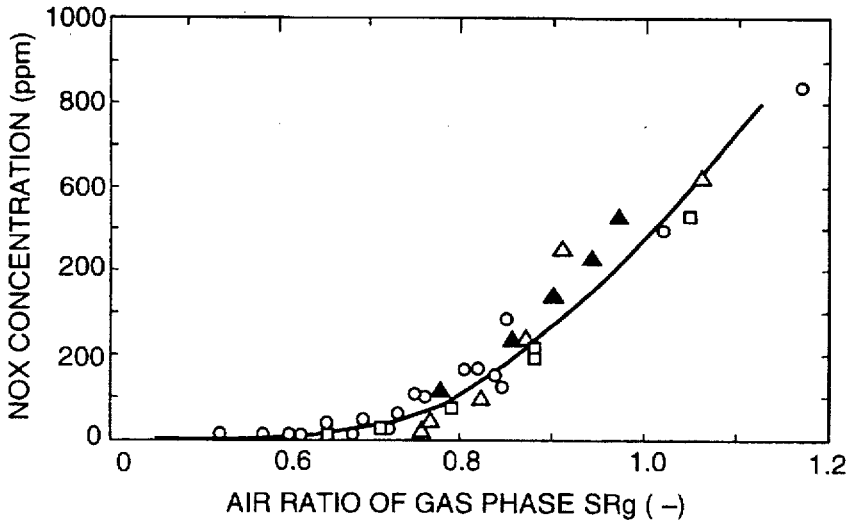
FIG. 5 is a characteristic graph showing the relationship between air ratio of gas phase and $NO_x$ concentration.

In pulverized coal burning, gas components such as oxygen, carbon dioxide, carbon monoxide, nitrogen, hydrogen, steam and so on are in an equilibrium state (an equilibrium condition) in gas phase. Therefore, an air ratio of gas phase and a gas concentration have a certain correlation. As an example, coals having characteristics shown in Table 1 were burned, and the relationship between the air ratio of gas phase and the gas concentration was investigated and the graphs shown in FIG. 4 and FIG. 5 are obtained. The graphs show results in a case of gas temperature of 1400° C.

TABLE 1

| KIND OF COAL | FUEL RATIO | ASH PORTION (wt %) | N PORTION (dry, ash free) (wt %) |
|---|---|---|---|
| coal A | 1.03 | 15.7 | 2.52 |
| coal B | 1.98 | 8.9 | 1.78 |
| coal C | 2.32 | 12.8 | 1.94 |
| coal D | 3.44 | 8.4 | 2.09 |

From the above fact, in pulverized coal burning, concentrations of gas compositions such as oxygen, carbon dioxide and so on are singularly determined by an air ratio of gas phase, and accordingly the gas reaction calculation can be simplified.

Figure 7:
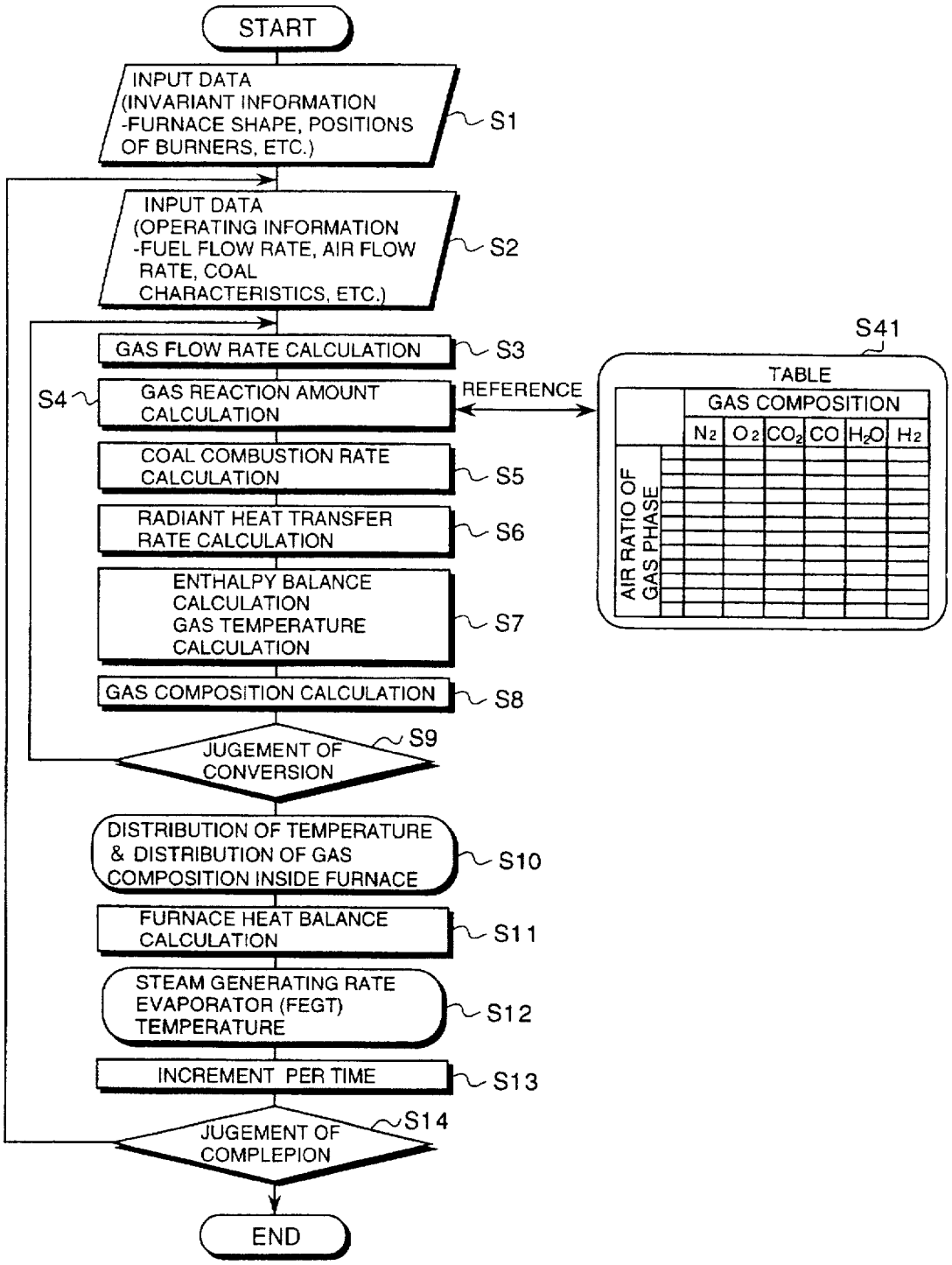
FIG. 7 is a flow chart showing another embodiment of calculation steps in accordance with the present invention.

FIG. 7 is a flow chart showing an embodiment of gas reaction calculation in which a table of gas compositions (S41) as an index of air ratio of gas phase, and the gas reaction calculation is executed by referring to the table instead of executing chemical equilibrium calculation.

Examples of the index used for the gas reaction calculation in FIG. 7 are shown in Table 2 and Table 3. Both of Table 2 and Table 3 show the relationship between the air ratio and gas compositions. Different point between Table 2 and Table 3 is in gas temperature. In Table 2 and Table 3, for example, E-17 indicates $x10^{-17}$ (for example, 6.42E–01= $6.42\times10^{-01}$).

TABLE 2

| Air ratio | GAS COMPOSITIONS (mole ratio:-) | | | | | |
|---|---|---|---|---|---|---|
| of gas phase | $N_2$ | $O_2$ | $CO_2$ | CO | $H_2O$ | $H_2$ |
| 0.62 | 6.42E-01 | 4.76E-27 | 1.08E-01 | 1.35E-01 | 2.23E-02 | 9.23E-02 |
| 0.67 | 6.61E-01 | 1.06E-20 | 1.07E-01 | 1.23E-01 | 4.30E-02 | 6.58E-02 |
| 0.72 | 6.77E-01 | 1.19E-16 | 1.10E-01 | 1.09E-01 | 5.86E-02 | 4.50E-02 |
| 0.76 | 6.92E-01 | 9.18E-14 | 1.17E-01 | 9.28E-02 | 6.90E-02 | 2.98E-02 |
| 0.81 | 7.05E-01 | 1.52E-11 | 1.25E-01 | 7.48E-02 | 7.54E-02 | 1.90E-02 |
| 0.86 | 7.18E-01 | 1.00E-09 | 1.36E-01 | 5.59E-02 | 7.90E-02 | 1.14E-02 |
| 0.91 | 7.29E-01 | 4.04E-08 | 1.47E-01 | 3.69E-02 | 8.06E-02 | 6.17E-03 |
| 0.95 | 7.40E-01 | 1.70E-06 | 1.59E-01 | 1.82E-02 | 8.09E-02 | 2.53E-03 |
| 1.00 | 7.49E-01 | 9.72E-04 | 1.68E-01 | 1.73E-03 | 8.00E-02 | 2.09E-04 |
| 1.05 | 7.51E-01 | 9.71E-03 | 1.62E-01 | 3.61E-04 | 7.66E-02 | 4.48E-05 |
| 1.09 | 7.53E-01 | 1.83E-02 | 1.55E-01 | 1.60E-04 | 7.33E-02 | 2.07E-05 |
| 1.14 | 7.55E-01 | 2.62E-02 | 1.49E-01 | 8.13E-05 | 7.03E-02 | 1.10E-05 |
| 1.19 | 7.56E-01 | 3.35E-02 | 1.43E-01 | 4.43E-05 | 6.75E-02 | 6.29E-06 |
| 1.28 | 7.59E-01 | 4.65F-02 | 1.32E-01 | 1.47E-05 | 6.25E-02 | 2.28E-06 |
| 1.38 | 7.61E-01 | 5.78E-02 | 1.23E-01 | 5.37E-06 | 5.82E-02 | 9.10E-07 |
| 1.47 | 7.63E-01 | 6.76E-02 | 1.15E-01 | 2.11E-06 | 5.44E-02 | 3.89E-07 |
| 1.57 | 7.64E-01 | 7.62E-02 | 1.08E-01 | 8.75E-07 | 5.12E-02 | 1.75E-07 |
| 1.66 | 7.66E-01 | 8.38E-02 | 1.02E-01 | 3.81E-07 | 4.82E-02 | 8.25E-08 |

TABLE 3

| Air ratio | GAS COMPOSITIONS (mole ratio:-) | | | | | |
|---|---|---|---|---|---|---|
| of gas phase | $N_2$ | $O_2$ | $CO_2$ | CO | $H_2O$ | $H_2$ |
| 0.62 | 6.42E-01 | 4.76E-27 | 1.08E-01 | 1.35E-^01 | 2.23E-02 | 9.23E-02 |
| 0.67 | 6.61E-01 | 1.06E-20 | 1.07E-01 | 1.23E-01 | 4.30E-02 | 6.58E-02 |
| 0.72 | 6.77E-01 | 1.19E-16 | 1.10E-01 | 1.09E-^01 | 5.86E-02 | 4.50E-02 |
| 0.76 | 6.92E-01 | 9.18E-14 | 1.17E-01 | 9.28E-02 | 6.90E-02 | 2.98E-02 |
| 0.81 | 7.05E-01 | 1.52E-11 | 1.25E-01 | 7.48E-02 | 7,54E-02 | 1.90E-02 |
| 0.86 | 7.18E-01 | 1.00E-09 | 1.36E-01 | 5.59E-02 | 7.90E-02 | 1.14E-02 |
| 0.91 | 7.29E-01 | 4.04E-08 | 1.47E-01 | 3.69E-02 | 8.06E-02 | 6.17E-03 |
| 0.95 | 7.40E-01 | 1.70E-06 | 1.59E-01 | 1.82E-02 | 8.06E-02 | 2.53E-03 |
| 1.00 | 7.49E-01 | 9.72E-04 | 1.68E-01 | 1.73E-03 | 8.00E-02 | 2.09E-04 |
| 1.05 | 7.51E-01 | 9.71E-03 | 1.62E-01 | 3.61E-04 | 7.66E-02 | 4.48E-05 |
| 1.09 | 7.53E-01 | 1.83E-02 | 1.55E-01 | 1.60E-04 | 7.33E-02 | 2.07E-05 |
| 1.14 | 7.55E-01 | 2.62E-02 | 1.49E-01 | 8.13E-05 | 7.03E-02 | 1.10E-05 |
| 1.19 | 7.56E-01 | 3.35E-02 | 1.43E-01 | 4.43E-05 | 6.75E-02 | 6.29E-06 |
| 1.28 | 7.59E-01 | 4.65E-02 | 1.32E-01 | 1.47E-05 | 6.25E-02 | 2.28E-06 |
| 1.38 | 7.61E-01 | 5.78E-02 | 1.23E-01 | 5.37E-06 | 5.82E-02 | 9.10E-07 |
| 1.47 | 7.63E-01 | 6.76E-02 | 1.15E-01 | 2.11E-06 | 5.44E-02 | 3.89E-07 |
| 1.57 | 7.64E-01 | 7.62E-02 | 1.08E-01 | 8.75E-07 | 5.12E-02 | 1.75E-07 |
| 1.66 | 7.66E-01 | 8.38E-02 | 1.02E-01 | 3.81E-07 | 4.82E-02 | 8.25E-08 |

Velocities at which hydrogen portion and carbon portion of pulverized coal are released in the burning process are different. Therefore, when the table of gas compositions as an index of air ratio of gas phase, it is preferable to make tables not only for a case of changing enthalpies having gases but also for a case of changing ratios of hydrogen portion and carbon portion. Enthalpy is a function of temperature and specific heat of a gas.

In the pulverized coal combustion furnace, in some cases, coal to be supplied may be changed with other coal during operation of the furnace. Further, the properties of coal such as contents of carbon and hydrogen, heat generation amount, ash content are different according to coal mining sites. Therefore, when the above-mentioned table of air ratio of gas phase-gas composition is prepared, it is desirable that the analyzer shown in FIG. 1 is provided, characteristics such as element ratios of carbon, hydrogen and oxygen, heat generation amount, etc. in coal are examined, and a table of air ratio of gas phase-gas composition which accords with the characteristics of a coal is used when the coal is supplied into the combustion furnace.

As shown in FIG. 2 and FIG. 7, after a distribution of temperature and a distribution of gas compositions inside the furnace are obtained, heat balance calculation (S11) is executed and then an amount of steam generation and temperature of the steam are calculated based on the result of the heat balance calculation (S12).

When the distribution of temperature and the distribution of gas compositions inside the furnace is obtained, an amount of heat received by the surface of the furnace wall can be calculated based on the result. Further, an amount of steam generated from the heat transfer pipes and the evaporators and temperatures of the heat transfer pipes and the evaporators can be calculated based on the amount of received and heat the thermal energy transferred to the heat exchangers inside the furnace 10 (S12). After that, the calculation time of the computer 50 is increased (S13), and it is judged whether the whole process is completed or not (S14). If the predetermined process is not completed, the processing is returned to the process of Step S2. If the predetermined process is completed, the processing is completed at this routine.

According to the present embodiment, the region inside the furnace 10 is divided into a plurality of two-dimensional or three-dimensional cells, and gas fluid flow, gas reaction, coal-gas reaction and radiant heat transfer for each of the cells are calculated using the invariant information (data specific to the furnace design) and the operating information under the condition that the gas compositions in relation to the burning inside the furnace 10 satisfies chemical equilibrium in regard to gas phase, and then using the results the distribution of temperature and the distribution of gas compositions inside the furnace 10 are calculated and estimated. Therefore, the time required for the gas reaction calculation can be shortened.

In the present embodiment, by multiplying the fluid flow (velocity) and the gas compositions in the cells facing the exit 20 side of the furnace 10, an amount of unburned portion can be obtained as a physical quantity in regard to burning at the exit 20.

Further, it is possible to use the calculated results as basic data for operating signals, and to compare each of the calculated results with each of preset values corresponding to the calculations and to correct an amount of fuel flow rate and an amount of air flow rate based on the compared results. For example, when an unburned portion increases, the unburned portion can be decreased by increasing an amount of air flow rate injected through the after-air injecting port 26.

An embodiment of controlling an operating condition, based on the state inside the furnace, obtained in the steps shown in FIG. 2 and FIG. 7 will be described below.

In the computer 50, concentrations of the unburned portion, carbon monoxide, oxygen and a temperature of gas at the exit of the furnace 10 are calculated, and the calculated result are compared with preset values to perform control corresponding to the compared results. In this case, when a calculated result exceeds a preset value, control is performed so that the compared result is brought within the range of the preset value while each value of the other items does not exceed each of the ranges of limit values.

For example, when a calculated value of a concentration of carbon monoxide at the exit 20 of the furnace 10 exceeds the preset value and the loads of the burners 22 and 24 are allowable to be increased, a burner load of the lower stage burner 22 is set higher within the range where stable burning limits of the burners 22, 24 do not exceed and a limit value of thermal distribution of the furnace 10 does not exceed. By taking priority to load setting of the lower stage burner 22, staying time of the pulverized coal in the furnace is increased and mixing of the pulverized coal with air is progressed, and accordingly amounts of exhausted unburned portion in ash and carbon monoxide can be reduced. That is, the heat load inside the furnace 10 can be known based on the calculation results according to the estimating program, and it is possible to employ the burning method in which the load of the burner 22 is set within the range of the heat load limit values of the furnace 10.

Next, control to increase the air ratio in the furnace 10 is performed by increasing the air flow rate injected through the burners 22, 24 and the after-air injecting ports 26, 28 so that the calculated result based on the estimating program approaches to the preset value. In this case, it is preferable that the increase of the air ratio is successively performed from the downstream region (upper portion in the side of the exit) of the furnace 10 when suppression of $NO_x$ is taken into consideration. By increasing the air ratio in such a manner, amounts of carbon monoxide and unburned portion in ash are decreased but an amount of $NO_x$ is generally increased.

Although the control to increase the air ratio is continued until difference between the calculated result and the preset value approaches to zero, the control is changed to an operation described below when the amount of $NO_x$ exceeds the limit value during this process. This operation is a method in which the grain size of the coal supplied to the furnace 10 is fined. This can be attained by automatically adjusting vane angles, loads and classifiers of the coal mills 42, 44 based on signals for setting conditions of the coal mills 42, 44. As the grain size of the coal is fined, the amount of unburned portion in ash is decreased because of increasing of burnability but required power for pulverization is increased.

Figure 8:
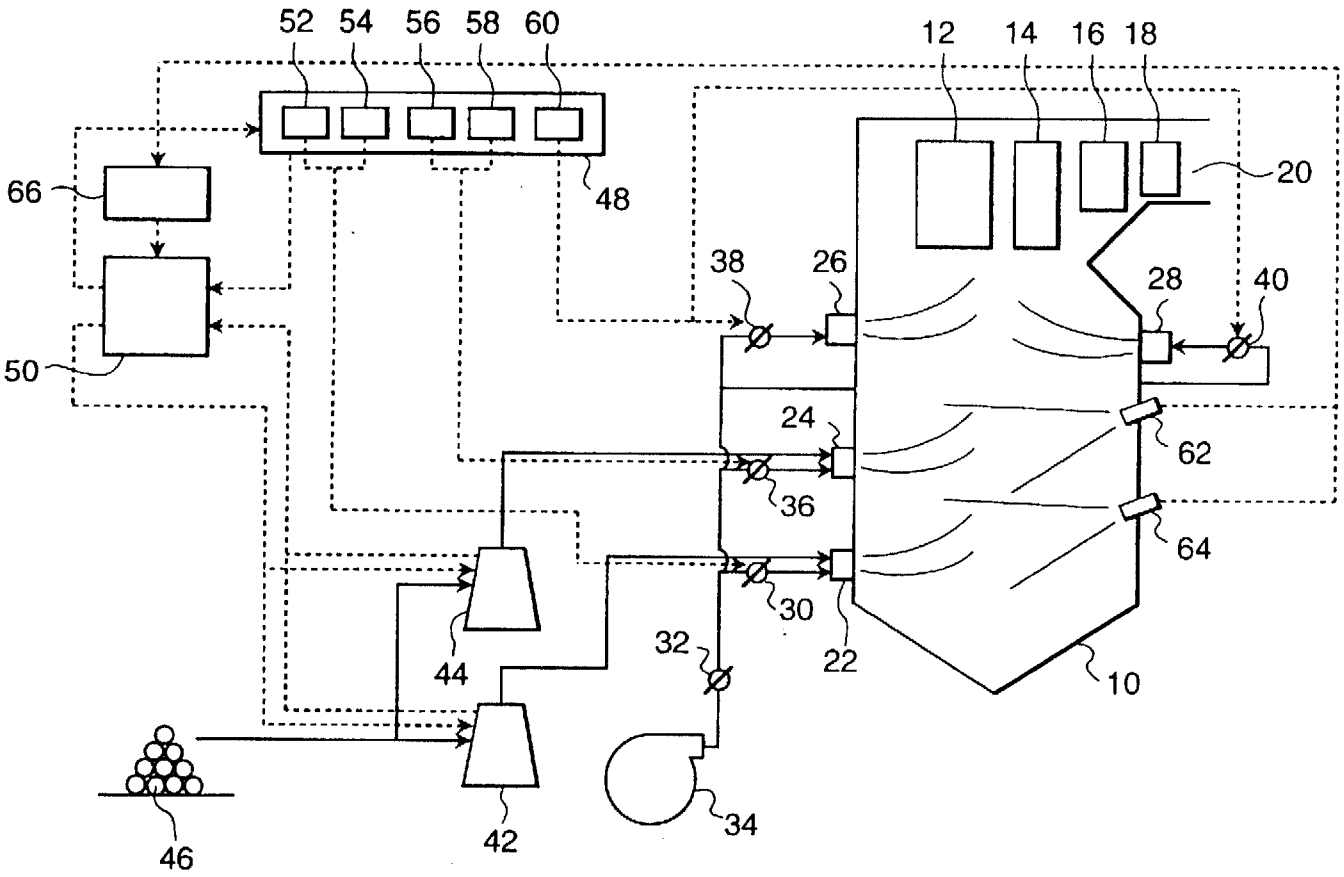
FIG. 8 is a view showing the overall construction of a second embodiment of a pulverized coal burning boiler in accordance with the present invention.
Figure 9:
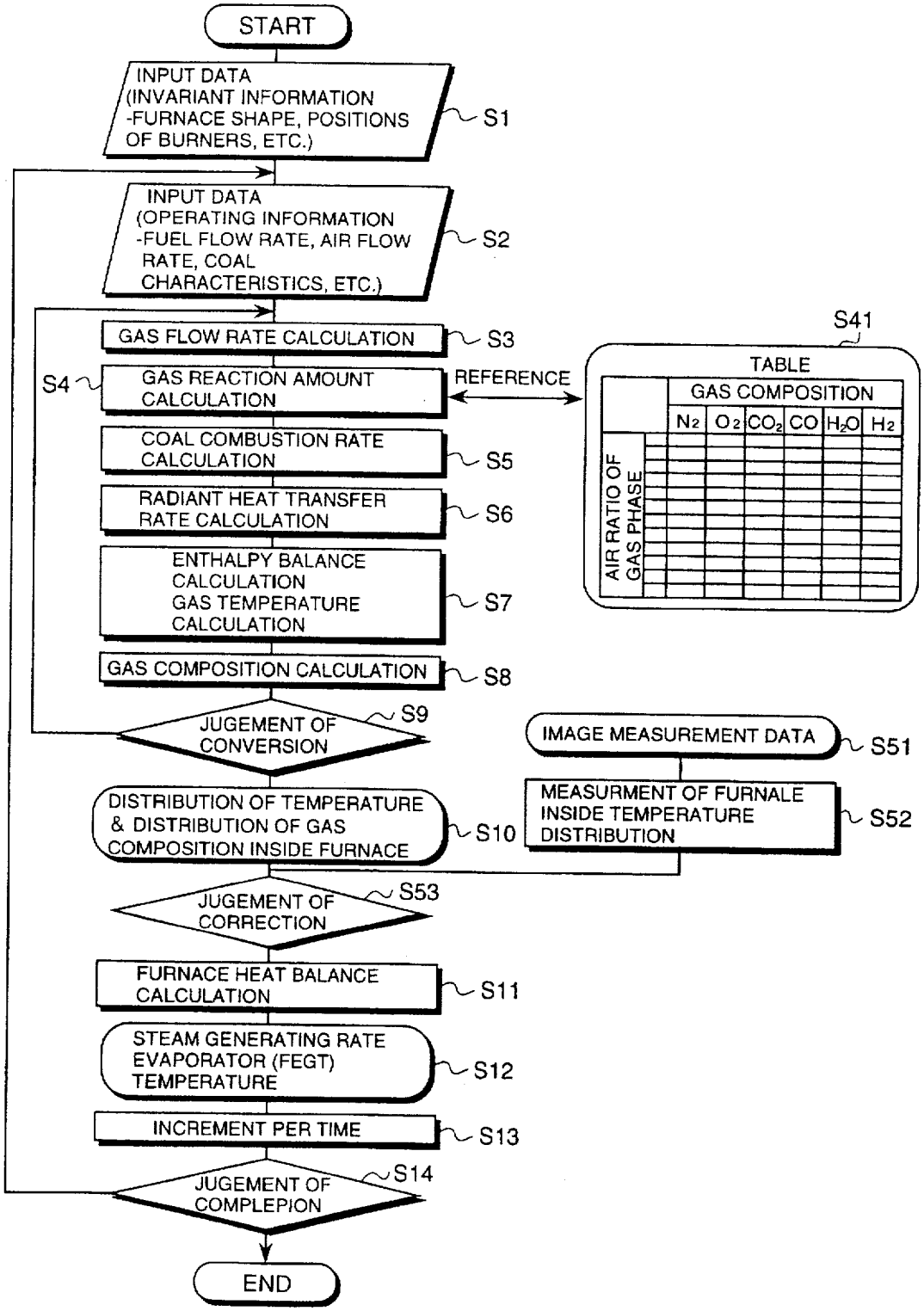
FIG. 9 is a flow chart showing a further embodiment of calculation steps in accordance with the present invention.

A second embodiment in accordance with the present invention will be described below, referring to FIG. 8 and FIG. 9.

In this embodiment, windows are provided on the wall surface of the furnace 10 and cameras 62, 64 for taking the state of flame inside the furnace 10 as images are also provided at the windows, and a distribution of temperature is obtained from the flame images by inputting the output signals of the cameras to an image processing apparatus 66 and the result is input to the computer 50. The computer 50 stores a program in relation to an algorithm for this purpose. The other points are the same as in the first embodiment. The steps S51 to S53 in regard to the image processing are added between the step S10 and the step S11 in FIG. 9.

The calculation in the steps S1 to S8 is only calculation of a furnace model and does not always realize the actual furnace operating state. Therefore, it is preferable that temperature measurement is performed on the actual furnace within a practical range and the distribution of temperature obtained by the calculation of the steps S1 to S8 is corrected using the measured result. It has been known that a distribution of temperature can be measured by taking an image of flame, converting the image into brightness information and performing image processing. By using this method, it is possible to measure temperature of an actual furnace. However, there is a structural limitation in a furnace in which cameras and sonic sensors can be installed, and number of temperature measured positions inside the furnace using these sensors is also limited to several points. Therefore, the calculation of the steps S1 to S8 are necessary.

Figure 10:
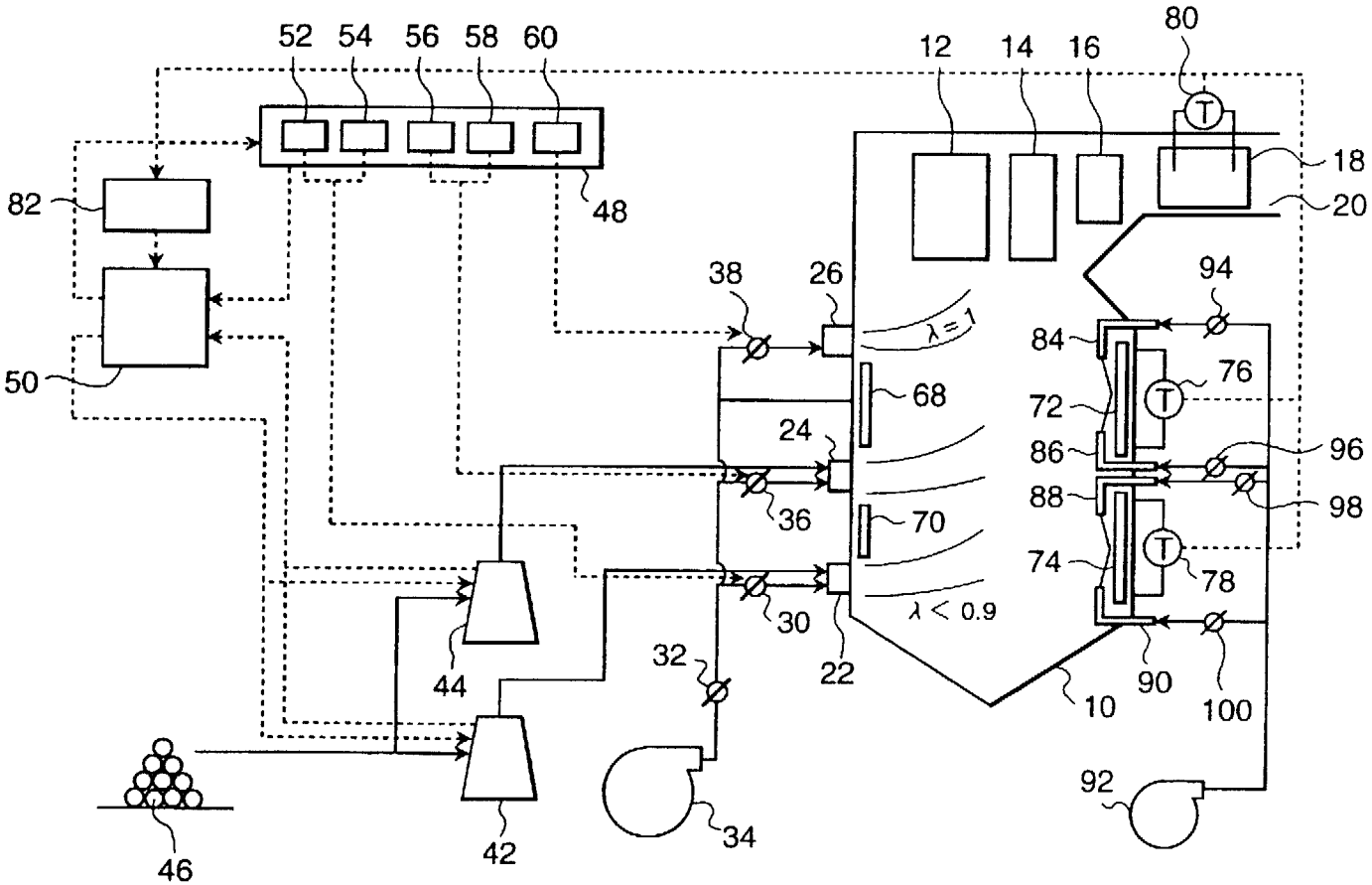
FIG. 10 is a view showing the overall construction of a third embodiment of a pulverized coal burning boiler in accordance with the present invention.

A third embodiment in accordance with the present invention will be described below, referring to FIG. 10.

In this embodiment, at least the heat transfer pipes 72, 74 among the heat transfer pipes 68, 70, 72, 74 provided on the furnace wall of the furnace 10 are provided with measurement devices 76, 78 for measuring temperature or pressure of the heat transfer pipes 72, 74, and a measured value of each of the measurement devices is input to the computer 50 through a signal processor 82, and the computer 50 calculates and estimates a thickness of ash attached to the heat transfer pipes 72, 74. When the calculated value exceeds a preset value, the ash attached to the heat transfer pipes 72, 74 is removed using soot blowers 84, 86, 88, 90. The other construction is the same as that in FIG. 1.

As the temperature of the heat transfer pipes 72, 74 is measure by the measurement devices 76, 78 and at the same time temperature of the evaporator 18 arranged in the exit side of the furnace 10 is measured by a measurement device 80, these signals are processed by the signal processor 82 and the processed result is input to the computer 50. The computer 50 can calculate and estimate the ash thickness attached to the heat transfer pipes 72, 74 using the processed result from the signal processor 82 and the amount of transferred heat calculated according to the estimating program. When the calculated result exceeds a preset value, a command for driving a soot blower fan 92 is output and an operator operates the fan 92.

As the fan 92 is operated, compressed air or steam is supplied from the fan 92 to each of the soot blowers 84 to 90 through flow regulators 94, 96, 98, 100. Each of the soot blowers 84, 86, 88, 90 is formed in a cylinder-shape, and a plurality of jet holes are formed in the middle of a pipe for each of the soot blowers 84, 86, 88, 90. When compressed air or steam is jetted from each of the jet holes by driving of the fan 92, the ash attached to the heat transfer pipes 72, 74 is removed by the compressed air or the steam.

The ash removal by the soot blower utilizes thermal shock by temperature difference between the substance attached to each of the heat transfer pipes 72, 74 and the substance jetted from each of the soot blowers, and the thermal shock affects life-time of the heat transfer pipes 72, 74. Therefore, the thickness of ash attached to each of the heat transfer pipes 72, 74 is individual calculated and estimated using the measured values measured by the measurement devices 78, 80 and the heat transfer rate obtained from the estimating program, and the ash removal operation only for a designated heat transfer pipe is performed by driving the fan 92 and opening a designated flow regulator among the flow regulators 94, 96, 98, 100 only when the calculated value exceeds the preset value.

A fourth embodiment in accordance with the present invention will be described below, referring to FIG. 11.

In this embodiment, operation of the pulverized coal burning boiler is controlled by monitoring temperature and pressure of steam in the inlet side of a steam turbine 104 connected to an electric power generator 102. The other construction is the same as that in FIG. 1.

Figure 11:
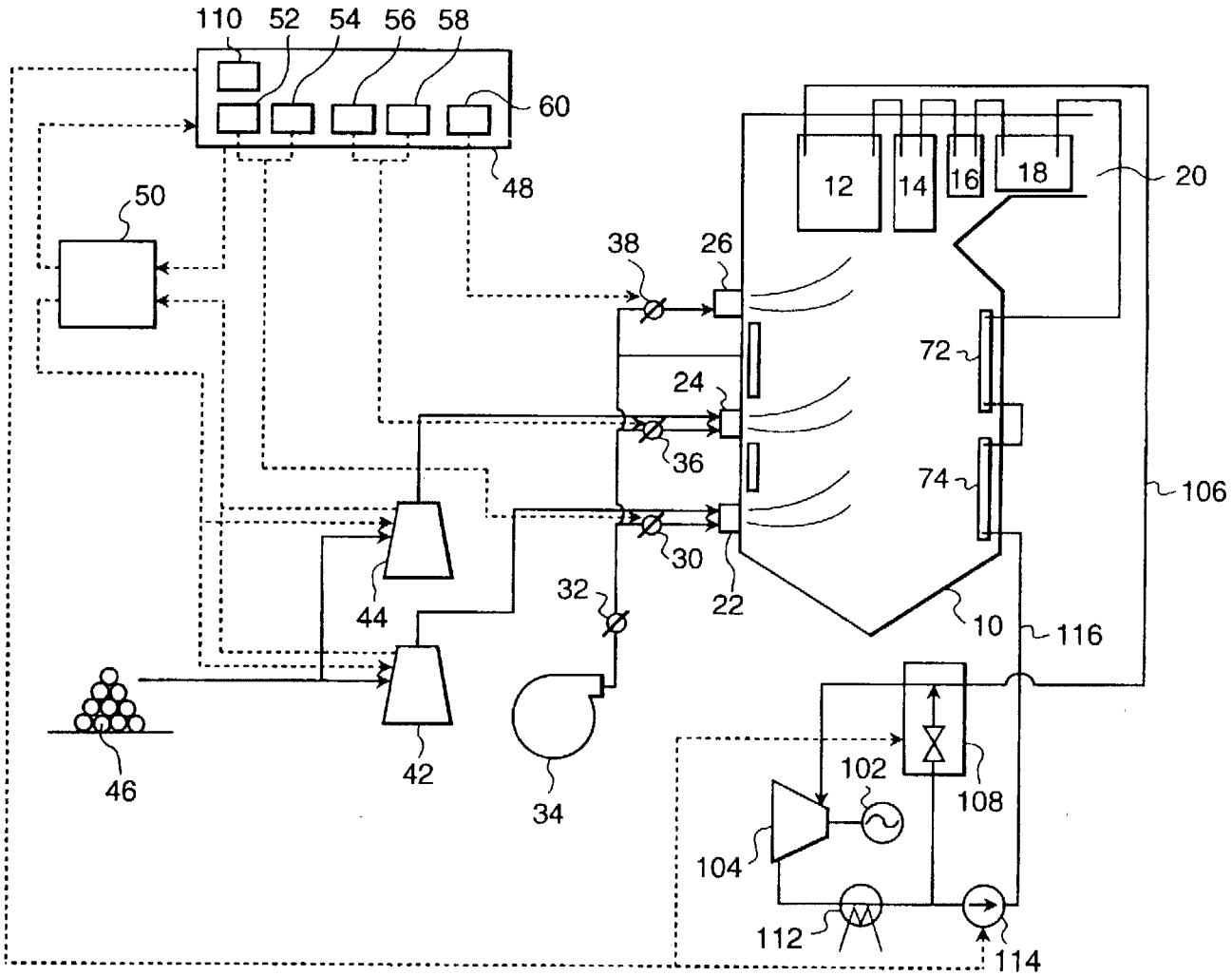
FIG. 11 is a view showing the overall construction of a fourth embodiment of a pulverized coal burning boiler in accordance with the present invention.

In FIG. 11, a spray apparatus 108 is provided in the middle of a pipe 106 for guiding steam from the evaporator 12 to the steam turbine 104, and the spray apparatus 108 mixes steam from the evaporator 12 with water input to a feed water pump 114 from a condenser 112 according to a control signal from a feed water system controller 110. The feed water pump 114 is connected to the heat transfer pipes 78, 72 and the evaporator 18 through a pipe 116. That is, heat generated inside the furnace 10 is absorbed to each of the evaporators 12, 14, 16, 18 and high temperature steam generated in the evaporator 12 is supplied to the steam turbine 104 through the spray apparatus 108, and the steam turbine 104 driven by the thermal energy drives the electric power generator 102. Steam passed through the steam turbine 104 is changed into water in the condenser 112, and water or steam is supplied to the heat transfer pipes 72, 74 by operation of the feed water pump 114.

When the steam turbine 104 is being operated, the computer 50 successively calculates and estimates a burning state inside the furnace 10 and calculates an amount of heat in connection to water or steam supplied to the heat transfer pipes 72, 74 based on an estimated result of the distribution of gas compositions and the distribution of temperature inside the furnace 10, and thermal physical properties in regard to a heat transfer coefficient and a heat radiation coefficient of the heat transfer pipe 72 arranged in the exit 20 side of the furnace wall of the furnace 10. Further, the computer calculates pressure and temperature of steam at the exit of the heat transfer pipe 72 or entering to the steam turbine 104 based on the heat supplied to the water or steam supplied to the heat transfer pipes 72, 74. The calculated results are displayed as check information for the operator as well as printed out from a printer. The calculated results are compared to preset values for operation as basic information for operating signals. According to the compared results, control signals are output from the feed water system controller 110 to the spray apparatus 108 and the feed water pump 114.

When the temperature and the pressure of the steam supplied to the steam turbine 104 are higher than preset values, the output of the steam turbine 104 exceeds a preset value, and the temperature and the pressure of the steam exceed the allowable values of the materials composing the steam turbine and fatigue and break may occurs in the materials. On the other hand, when the temperature and the pressure of the steam are lower than the preset values, steam is condensed inside the steam turbine 104 due to lowering of the temperature and the pressure of the steam, and corrosion of the turbine material and abnormal vibration may occur. When the temperature and the pressure of the steam largely fluctuate even if the temperature and the pressure of the steam are within the ranges of preset values, the life-time of the steam turbine 104 may be shortened due to thermal fatigue of the material. Therefore, it is necessary that operation of the spray apparatus 108 is controlled so as to decrease the fluctuation of the temperature and the pressure of the steam.

In order to operate the spray apparatus effectively, in the present embodiment, based on the calculated results according to the estimating program a burning state inside the furnace 10 is understood and an amount of heat absorbed to water or steam supplied to the heat transfer pipes 72, 74 is calculated, and from the calculated result pressure and temperature of steam flowing into the steam turbine is estimated, and according to the estimated result the spray apparatus 108 and the feed water pump 114 are controlled and a fuel supply rate to the burners 22, 24 is controlled.

By controlling the fuel supplying rate to the burners 22, 24 and the feed water flow rate to the heat transfer pipes 72, 74 using the calculated results according to the estimating program, the pressure and the temperature of the steam at the inlet side of the steam turbine 104 can be maintained at the preset values with suppressing the frequency of using the spray apparatus 108. For example, when it is expected that the values of the steam at the inlet side of the steam turbine 104 exceeds the preset values, the temperature can be suppressed within the preset value by inputting an operating command to the feed water pump 114 to increase the feed water flow rate to the heat transfer pipe 74. In this case, by controlling the fuel supply rate to the burners 22, 24, it is possible to obtain a higher load response with satisfying limiting conditions such as thermal stress.

Figure 12:
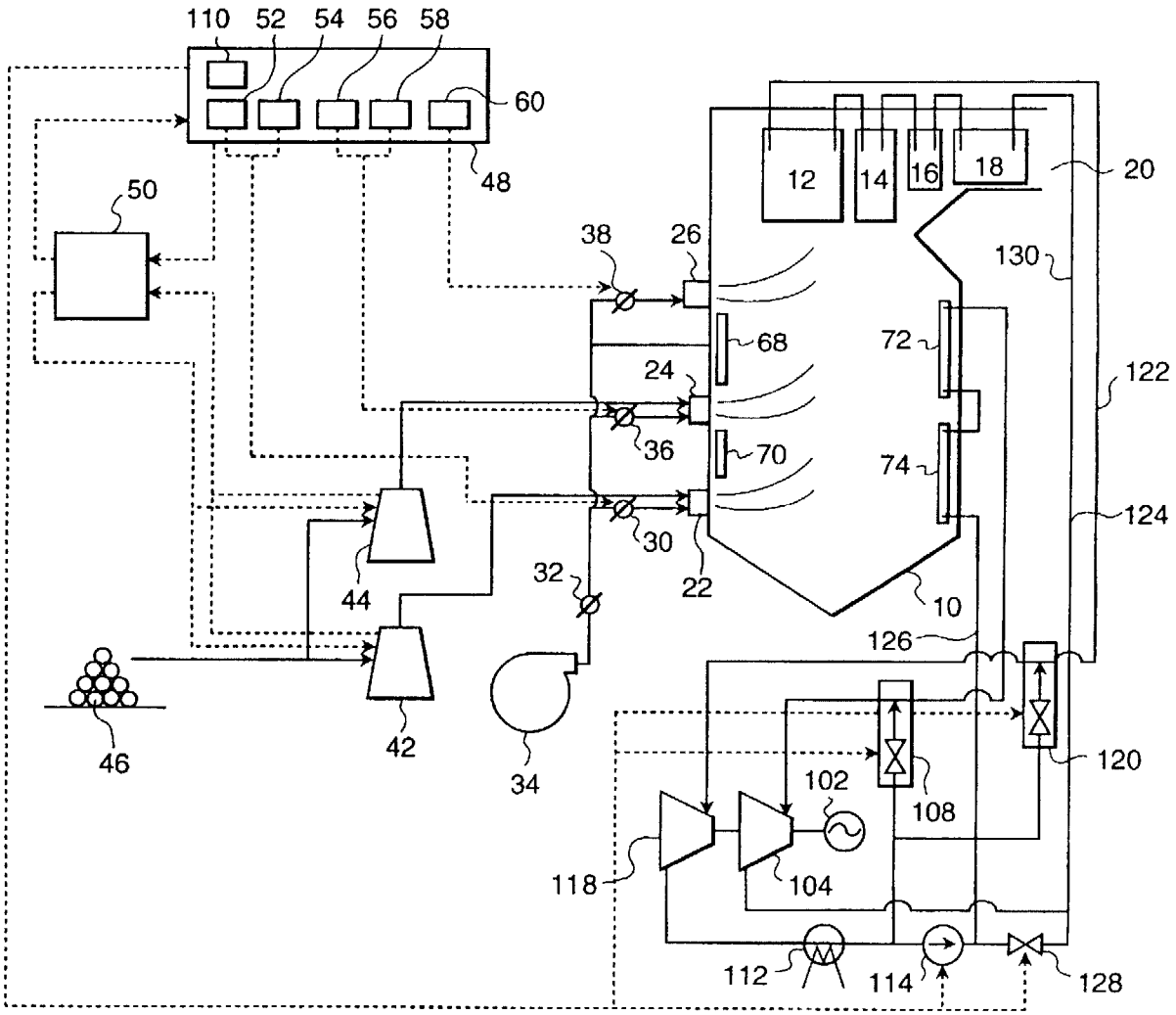
FIG. 12 is a view showing the overall construction of a fifth embodiment of a pulverized coal burning boiler in accordance with the present invention.

A fifth embodiment in accordance with the present invention will be described below, referring to FIG. 12.

In this embodiment, the electric power generator 102 is connected to a steam turbine 104 and a steam turbine 118, and a spray apparatus 108 and a spray apparatus 120 are provided. Steam from the evaporator 12 is supplied to the steam turbine 118 through a pipe 122 and the spray apparatus 120, and steam from the heat transfer pipe 72 is supplied to the steam turbine 104 through a pipe 124 and the spray apparatus 108, and water from a feed water pump 114 is supplied to the heat transfer pipe 124 through a pipe 126, and further water from the feed water pump 114 is supplied to an evaporator 118 through a branch valve (flow control valve) 128 and a pipe 130. The other construction is the same as that of FIG. 11. The control signal from the feed water system controller 110 is supplied to the spray apparatuses 108, 120 and at the same time supplied also to the feed water pump 114 and the branch valve 128. Further, the inlet side of the steam turbine is connected to the evaporator 18 through a pipe 130.

In this embodiment, a burning state inside the furnace 10 is understood and an amount of heat of water or steam flowing through the heat transfer pipes 72, 74 is calculated based on a calculated results according to the estimating program, and from the calculated result a pressure and a temperature of steam flowing into the steam turbines 104, 118 are estimated, and an amount of fuel supplied to the burners 22, 24 and an amount of feed water to the heat transfer pipe 74 and to the evaporator 18 are controlled using the estimated result. By doing so, the pressure and the temperature at the inlet side of the steam turbines 104, 118 are maintained at preset values with suppressing the frequency of using the spray apparatuses 108, 120.

Further, in this embodiment, opening of the branch valve 128 is made controllable in taking it into consideration to operate the pulverized coal burning boiler with partial load by stopping the upper stage burner 24. That is, during partial load operation, there are some cases where the heat absorption inside the furnace 10 becomes large and the heat absorption of the evaporator 18 arranged in the exit 20 side of the furnace 10 becomes small. In such a case, pressure and temperature of steam obtained through each of the heat transfer pipes 72, 74 are fluctuated. However, according to the present embodiment, since an amount of heat absorbed in each of the heat transfer pipes 72, 74 can be understood according to the calculated results of the estimating program, the temperature and the pressure at the inlet side of each of the steam turbines 104, 118 can be estimated even when different temperature and different pressure steam flows into each of the steam turbines 104, 118. When the estimated results deviates from the preset values, the temperature and the pressure at the inlet side of each of the steam turbines 104, 118 can be maintained at the preset values, for example, by increasing the feed water flow rate to the heat transfer pipe 74 and decreasing the feed water flow rate to the evaporator 18 through operating the branch valve 128.

The aforementioned embodiments have described the pulverized coal burning boiler of one-side burning type in which the burners 22, 24 are arranged on one side of the furnace wall of the furnace 10. However, the present invention can be applied to a furnace of opposite burning type in which a plurality of burners are oppositely arranged or a furnace of corner firing type in which swirl flow is formed in the horizontal direction inside the furnace.

Figure 13A:
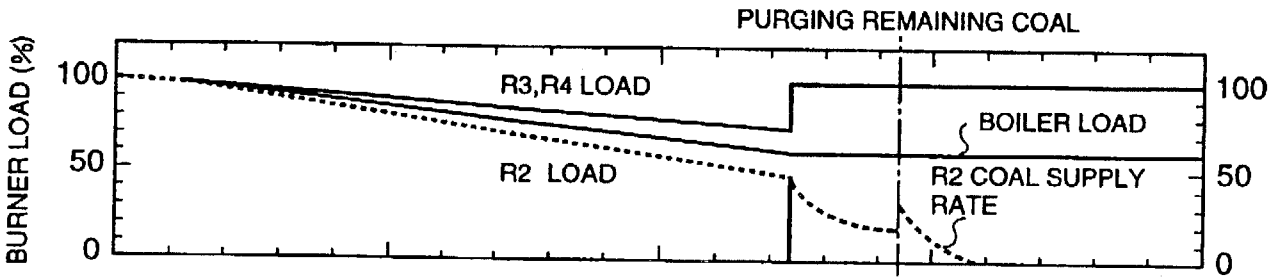
FIG. 13 is a chart showing characteristic of gas concentrations at burner load change.
Figure 13B:
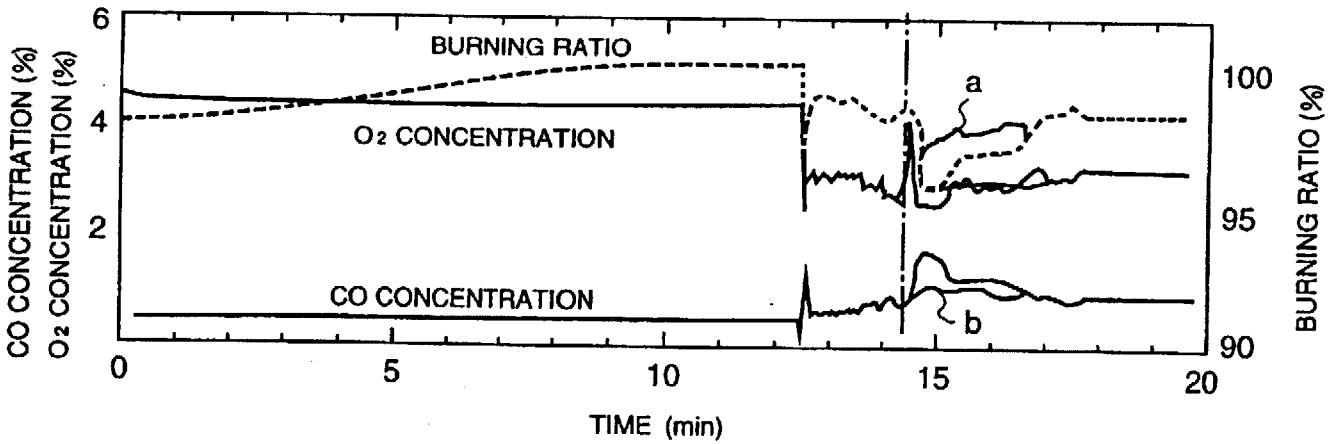

An amount of carbon monoxide and an amount of unburned portion in ash sometimes change abruptly and exceed the limit values during load change. Especially in a case of switching operation of the burners, when pulverized coal remaining in a pulverized coal pipe (a pulverized coal transferring pipe connected between the coal mill 42 or 44 and the burner 22 or 24) accompanied by firing and stopping operation of the burners, an amount of carbon monoxide and an amount of unburned portion in ash may exceed the limit values. FIG. 13 is one of the examples which shows change in carbon monoxide concentration inside the furnace 10 when burners of three-stage construction are provided in the furnace 10, and operation of the burner in the first stage is stopped as the load is being decreased. As the burner indicated by reference character R2 is stopped, pulverized coal inside the pulverized coal pipe is usually released by injecting air into the pulverized coal pipe pulsatively so as to prevent the pulverized coal remaining the pulverized coal pipe from fine-particle explosion or abnormal burning. At this time, high concentration pulverized coal is released in the furnace 10 in a moment. Therefore, an air ratio of the furnace 10 is decreased in a moment, and consequently the concentration of CO and the concentration of unburned portion in ash are increased. As for a method of suppressing increase in the concentration of CO and the concentration of unburned portion in ash, there has been a method of increasing air flow rate in the after-air injecting port. However, it is difficult to match the timing for injecting air properly.

By performing the estimating calculation according to the present invention, an amount of air at the after-air injecting port can be increased and decreased by predicting a time lag between injection of remaining pulverized coal from the after-air injecting port and mixing of the injected pulverized coal with air, and the amounts of CO and unburned portion in ash can be suppressed below the limit values with a minimum necessary amount of air as shown in the figure by the reference characters a and b.

As having been described above, according to the present invention, when fluid flow, gas reaction, coal-gas reaction, radiant heat transfer in each of the cells are calculated based on data specific to a furnace design and operating information, the gas reaction is calculated under a condition that a chemical equilibrium is satisfied. Therefore, the calculation of gas reaction can be simplified and accordingly the burning state can be rapidly estimated.

Further, according to the present invention, gas reaction is calculated by searching a table by which gas compositions can be obtained with indexes of air ratio of gas phase and enthalpy of gas phase. Therefore, calculation of gas reaction can be further simplified.

What is claimed is:

1. A furnace inside state estimation control apparatus of a pulverized coal combustion furnace, comprising a calculation program for obtaining, by calculation, at least one of a distribution of temperature and a distribution of gas compositions inside the pulverized coal combustion furnace, a display for displaying at least one of the distribution of temperature and the distribution of gas composition, obtained by the calculation program, and a control means for controlling operation conditions on the basis of at least one of the distribution of temperature and the distribution of gas composition, wherein said furnace inside state estimation control apparatus further comprises a table of air ratio of gas phase-gas composition in which the gas composition produced by combustion of coal under the conditions of furnace inside temperature from 1000K to 2500K and the conditions of gas composition of a air ratio of gas phase from 0.6 to 4.0 are obtained from gas reaction calculation or from sampling results of the reaction furnace and arranged in a relation with the air ratio of gas phase, and said calculation program includes all the following first to fourth steps and at least one of the following fifth and sixth steps;

(1) the first step of dividing the inside of the furnace into a plurality of two-dimensional or three-dimensional cells, executing gas flow rate calculation for each of the cells from data specific to the furnace design including the furnace dimensions and operational data including a coal feeding rate and air supply rate to obtain enthalpy entered each cell, enthalpy come out of each cell, components and amount of gas and an amount of coal, each entering each cell;

(2) the second step of calculating air ratio of gas phase and specific heat of gas phase of each cell from the components and amount of gas entering each cell, obtained in the first step and initial temperature of each cell, searching the table of air ratio of gas phase-gas composition by indexes of the obtained air ratio of gas phase to obtain the composition and amount of gas corresponding to the air ratio of gas phase;

(3) the third step of obtaining an amount of heat generation by combustion of coal and components and amount of gas converted from the coal for each cell on the basis of the components and amount of the gas, obtained in the second step, an amount of coal in each cell, obtained from the amount of coal entering each cell and the amount of coal from each cell, and the initial temperature of each cell used for calculation in the second step;

(4) the fourth step of obtaining radiant heat transfer amount of each cell from the initial temperature of each cell, used for calculation in the second step;

(5) the fifth step of calculating enthalpy in each cell from the enthalpy to each cell and enthalpy from each cell, obtained in the first step, the heat generation amount of coal in each cell, obtained in the third step and the radiant heat transfer amount of each cell, obtained in the fourth step, and calculating temperature of each cell from the enthalpy and the specific heat of each cell, obtained in the second step to obtain a temperature distribution inside the furnace; and (6) the sixth step of calculating components and amount of gas in each cell from the components and amount of gas entered each cell, obtained in the first step, the components and amount of gas of each cell, obtained in the second step, the components and amount of gas converted from coal, obtained in the third step to obtain a gas composition distribution inside the furnace.

2. A furnace inside state estimation control apparatus of a pulverized coal combustion furnace according to claim 1, wherein said calculation program includes the step of comparing a temperature of at least one cell among respective temperatures of the cells obtained in the fifth step with the previous calculated temperature of the at least one cell, repeating the calculation of the second step to the fifth step, using the current calculated temperature when the difference exceeds a preset allowable temperature difference, and repeatedly executing the calculation using new calculated temperature until the difference the above-mentioned previous calculated temperature and new calculated temperature converges within the allowable temperature difference.

3. A furnace inside state estimation control apparatus of a pulverized coal combustion furnace according to claim 2, wherein the cell the previous calculated value of which is compared with the allowable temperature difference is a cell at an outlet of the furnace.

4. A furnace inside state estimation control apparatus of a pulverized coal combustion furnace according to claim 1, wherein a plurality of tables of air ratio of gas phase-gas composition are provided according to a ratio between hydrogen and carbon in pulverized coal, or a ratio between carbon, hydrogen and oxygen.

5. A furnace inside state estimation control apparatus of a pulverized coal combustion furnace according to claim 1, wherein an analyzer is provided which obtains an element ratio between carbon, hydrogen and oxygen in pulverized coal and an amount of heat generation of the pulverized coal, and when a furnace inside state of the combustion furnace is estimated, the table of air ratio of gas phase-gas composition met with the analysis result of the pulverized coal is used.

6. A furnace inside state estimation control apparatus of a pulverized coal combustion furnace according to claim 1, wherein said combustion furnace is provided with a plurality of burners for jetting pulverized coal and carrier gas of the coal and an after air supply port at a furnace wall thereof, and said control means controls air supply rates for the plurality of burners and the after air supply port so that an air ratio in a lower region than the after air supply port does not exceed 0.85.

7. A furnace inside state estimation control apparatus of a pulverized coal combustion furnace according to claim 1, wherein said combustion furnace is provided with a plurality of burners for jetting pulverized coal and carrier gas of the coal and an after air supply port at a furnace wall thereof, and said control means compares a coal combustion rate at the furnace outlet, estimated from the distribution of furnace inside temperature obtained by the calculation program with a preset coal combustion rate at the furnace outlet, and controls an air supply rate for the plurality of burners and the after air supply port so that the estimated coal combustion rate is higher than the preset value.

8. A furnace inside state estimation control apparatus of a pulverized coal combustion furnace according to claim 1, wherein said combustion furnace is provided with a plurality of burners for jetting pulverized coal and carrier gas of the coal and an after air supply port at a furnace wall thereof, and said control means compares a gas composition at the furnace outlet, estimated from the distribution of furnace inside gas composition obtained by the calculation program with a preset gas composition at the furnace outlet, and controls an air supply rate for the plurality of burners and the after air supply port and a coal supply rate for the plurality of burners so that the estimated gas composition is within the preset value.

9. A furnace inside state estimation control apparatus of a pulverized coal combustion furnace according to claim 1, wherein said combustion furnace is provided with a plurality of burners for jetting pulverized coal and carrier gas of the coal and an after air supply port at a furnace wall thereof and a heat exchanger inside the combustion furnace, and said control means obtains thermal energy absorbed in the furnace wall and the heat exchanger from the distribution of furnace inside temperature obtained by the calculation program, calculates a temperature and amount of steam generated in the heat exchanger and controls at least one of an air supply rate for the plurality of burners and the after air supply port, a coal supply rate for the plurality of burners and a water supply rate for the heat exchanger so that the calculated temperature and amount of steam are within the preset values.

10. A furnace inside state estimation control apparatus of a pulverized coal combustion furnace according to claim 1, further including a temperature measuring means for measuring temperature from the brilliance of flame of the combustion furnace and a temperature correcting means for correcting the temperature distribution obtained in the fifth step on the basis of a measured temperature value.

11. A furnace inside state estimation control apparatus of a pulverized coal combustion furnace according to claim 1, wherein said combustion furnace is provided with a plurality of burners for jetting pulverized coal and carrier gas of the coal and an after air supply port at a furnace wall thereof and a heat exchanger inside the combustion furnace, and the controller obtains thermal energy absorbed in the furnace wall and the heat exchanger from the distribution of furnace inside temperature obtained by the calculation program, calculates a temperature and pressure of steam generated in the heat exchanger, estimates the thickness of combustion ash adhered to the heat exchanger on the basis of time hysteresis of deviation between the calculated value and the temperature and pressure of steam really generated in the heat exchanger, and instructs an ash adhesion operation to the heat exchanger when the estimated value exceeds a preset value.

* * * * *